US010703614B2

(12) United States Patent
Murayama

(10) Patent No.: US 10,703,614 B2
(45) Date of Patent: Jul. 7, 2020

(54) GANTRY FOR CONSTRUCTION MACHINE

(71) Applicant: KOBELCO CONSTRUCTION MACHINERY CO., LTD., Hiroshima-shi (JP)

(72) Inventor: Yasuhiko Murayama, Hyogo (JP)

(73) Assignee: KOBELCO CONSTRUCTION MACHINERY CO., LTD., Hiroshima-shi (JP)

( * ) Notice: Subject to any disclaimer, the term of this patent is extended or adjusted under 35 U.S.C. 154(b) by 48 days.

(21) Appl. No.: 16/306,188

(22) PCT Filed: May 31, 2017

(86) PCT No.: PCT/JP2017/020221

§ 371 (c)(1),
(2) Date: Nov. 30, 2018

(87) PCT Pub. No.: WO2018/003385

PCT Pub. Date: Jan. 4, 2018

(65) Prior Publication Data

US 2020/0039800 A1 Feb. 6, 2020

(30) Foreign Application Priority Data

Jun. 30, 2016 (JP) ..... 2016-130998

(51) Int. Cl.
*B66C 23/82* (2006.01)

(52) U.S. Cl.
CPC ..... *B66C 23/823* (2013.01)

(58) Field of Classification Search
CPC ..... B66C 23/06; B66C 23/365; B66C 23/821–826
See application file for complete search history.

(56) References Cited

FOREIGN PATENT DOCUMENTS

| | | | |
|---|---|---|---|
| CN | 103552940 | A | 2/2014 |
| CN | 104210969 | A | 12/2014 |
| EP | 2275378 | A1 | 1/2011 |
| JP | 2000-198672 | A | 7/2000 |
| JP | 2011-37628 | A | 2/2011 |
| JP | 2012-236659 | A | 12/2012 |

OTHER PUBLICATIONS

International Search Report dated Sep. 5, 2017, in PCT/JP2017/020221, filed May 31, 2017.

*Primary Examiner* — Sang K Kim
*Assistant Examiner* — Nathaniel L Adams
(74) *Attorney, Agent, or Firm* — Oblon, McClelland, Maier & Neustadt, L.L.P.

(57) ABSTRACT

A gantry for a construction machine. The gantry includes a front leg, an upper rear leg, a lower rear leg, and a connection member. The connection member connects an interconnection section for interconnecting the front leg and the upper rear leg to a base. The connection member includes an upper end portion rotatably connected to the interconnection section. The connection member includes a shaft section and the upper rear leg includes a shaft holding portion for holding the shaft section. The shaft holding portion includes a shaft holding surface for holding a lower end portion of the shaft section, a dislodgement prevention portion, and a guide portion inclined downward forward to guide the shaft section to the shaft holding surface. The shaft section climbs over the dislodgement prevention portion through relative displacement to the connection member in a rotation radial direction.

2 Claims, 10 Drawing Sheets

GANTRY FOR CONSTRUCTION MACHINE

TECHNICAL FIELD

The present invention relates to a gantry for a construction machine.

BACKGROUND ART

There is conventionally known a gantry for a construction machine as disclosed in Patent Literature 1. FIG. 9 shows a gantry 9 equivalent to the aforementioned gantry. The gantry 9 includes a front leg 91, an upper rear leg 92, a lower rear leg 93, and a interconnection section 94. In a working state of the construction machine, the upper rear leg 92 and the lower rear leg 93 extend substantially vertically, and the front leg 91 is inclined obliquely downward and forward. Besides, in a stored state of the construction machine, the lower rear leg 93 and the upper rear leg 92 are lowered while folded, and the front leg 91 is lowered onto the folded upper rear leg 92.

The construction machine includes a slowing frame 90 as a base. The gantry 9 further includes the interconnection section 94 for interconnecting the front leg 91 and the upper rear leg 92 and a connecting rod 95 for connecting the interconnection section 94 to the slewing frame 90 to keep the stored state. The connecting rod 95 includes an upper end portion connected to the interconnection section 94 so as to be a rotation center of the connecting rod 95, and a lower end portion formed with a pin insertion hole 951. The slewing frame 90 is also formed with a pin insertion hole 901, and a pin is inserted into the pin insertion holes 951, 901 to keep the stored state.

With such a construction machine, when a construction work is performed without fixing the lower end portion of the connecting rod 95, the connecting rod 95 possibly swings to collide against the upper rear log 92 and the like, involving damage in paint on the upper rear leg 92 and the connecting rod 95 or occurrence of collision sound. For the reason, the gantry disclosed in Patent Literature 1 includes, as shown in FIG. 9, an engaging pin 96 provided as a shaft portion to the connecting rod 95 and an engagement groove 97 provided as a shaft holding portion at the upper rear leg 92. The engaging pin 96 and the engagement groove 97 are engaged with each other in the working state to prevent the connecting rod 95 from swinging.

Furthermore, with the gantry 9 shown in FIG. 9, upon folding the front leg 91, the upper rear leg 92 and the lower rear leg 93 to enter the stored state, the engaging pin 96 moves from a shaft holding surface 971 of the engagement groove 97 holding the engaging pin 96 over a dislodgement prevention portion 972 located above the shaft holding surface 971 to be dislodged, as shown in FIG. 10. This allows holding of the connecting rod 95 by the shaft holding portion of the upper rear leg 92 to be automatically released.

The conventional gantry described above, however, does not enable the engaging pin 96 of the connecting rod 95 and the engagement groove 97 to be automatically engaged with each other at the time of transition from the stored state to the working state. This requires the engaging pin 96 and the engagement groove 97 to be manually engaged. Such a manual engagement task is burdensome. For example, a worker cannot reach an engagement portion with no step.

CITATION LIST

Patent Literature

Patent Literature 1: JP 2011-37628 A

SUMMARY OF INVENTION

An object of the present invention is to provide a gantry for a construction machine, the gantry being capable of transition from a stored state to a working state and enabling a connection member for keeping the stored state to be easily restrained from swinging in the working state.

Provided is a gantry installed on a base of a construction machine, the gantry including: a front leg including a proximal end portion rotatably connected to a front support portion of the base so as to be able to be raised and lowered relatively to the base and a movable end portion opposite to the proximal end portion; an upper rear leg including a first upper end portion rotatably connected to the movable end portion of the front leg anti a first lower end portion opposite to the first upper end portion; a lower rear leg including a second upper end portion rotatably connected to the first lower end portion of the upper rear leg and a second lower end portion rotatably connected to a rear support portion of the base, the rear support portion being a portion located on a rear side of the front support portion; a front-rear interconnection section interconnecting the movable end portion of the front leg and the first upper end portion of the upper rear leg, the front-rear interconnection section being rotatably connected to at least one of the movable end portion and the first upper end portion; and a connection member. The gantry is capable of transition between a working state in which the upper rear leg and the lower rear leg extend substantially vertically and the front leg is inclined obliquely downward and forward and a stored state in which the upper rear leg and the lower rear leg are lowered while being folded so as to locate the first lower end portion of the upper rear leg on a front side of the first upper end portion and so as to locate the second upper end portion of the lower rear leg on a front side of the second lower end portion, and the front leg is lowered onto the upper rear leg having been folded. The connection member is provided to connect the front-rear interconnection section to the base to keep the stored state, including a first connection end portion and a second connection end portion that are longitudinal opposite end portions of the connection member, the second connection end portion being connected to a connection part of the interconnection section, the connection part being located on a rear side of the first upper end portion of the upper rear leg, so as to allow the first connection end portion to rotate in a direction of moving toward or away from the upper rear leg. The first connection end portion includes a first storage connection portion configured to be connected to a second storage connection portion to keep the stored state, the second storage connection portion being a portion of one of the upper rear leg, the lower rear leg, and the base. The connection member includes a connection member main body including the first connection end portion and the second connection end portion, and a shaft section protruding beyond the connection-member main body in an axial direction that is a direction orthogonal to a longitudinal direction of the connection member and orthogonal to the direction of moving toward or away from the upper rear leg, at a position between the first connection end portion and the second connection end portion in the connection-member main body. The upper rear leg includes a shaft holding portion that protrudes rearward from the upper rear leg and holds the shaft section in the working state, and the shaft holding portion includes a shaft holding surface that receives a lower end portion of the shaft section of the connection member that is suspended by a weight of the connection member from the second connection end portion that is a rotation center, a dislodgement prevention portion located on a rear side of the shaft holding surface and above the shaft holding surface and configured to restrain the shaft section from rearward movement to prevent the shaft section from being dislodged from the shaft holding surface, and a guide portion located on a rear side of the dislodgement prevention portion and configured to come into contact with the lower end portion of the shaft section of the connection member that is suspended by the weight of the connection member from the second connection end portion when the upper rear leg and the lower rear leg are raised to extend substantially vertically from a state where the upper rear leg and the lower rear leg are lowered and folded, the guide portion being inclined downward and frontward so as to guide the shaft section to the shaft holding surface. A part of the connection member which part includes at least the shaft section is capable of relative displacement to the shaft holding portion in a rotation radial direction of rotation of the connection member around the second connection end portion, the relative displacement allowing the shaft section to climb over the dislodgement prevention portion.

DESCRIPTION OF EMBODIMENTS

There will be described an embodiment of the present invention with reference to FIGS. 1 to 8.

The present invention is applicable to a gantry for various construction machines such as cranes, pile drivers, and the like. The crane may be any crane, which is typified by a crawler crane, but includes various cranes such as a mobile crane and a fixed crane. The construction machine of the embodiment described below is a crawler crane 1 shown in FIG. 1.

Figure 1:
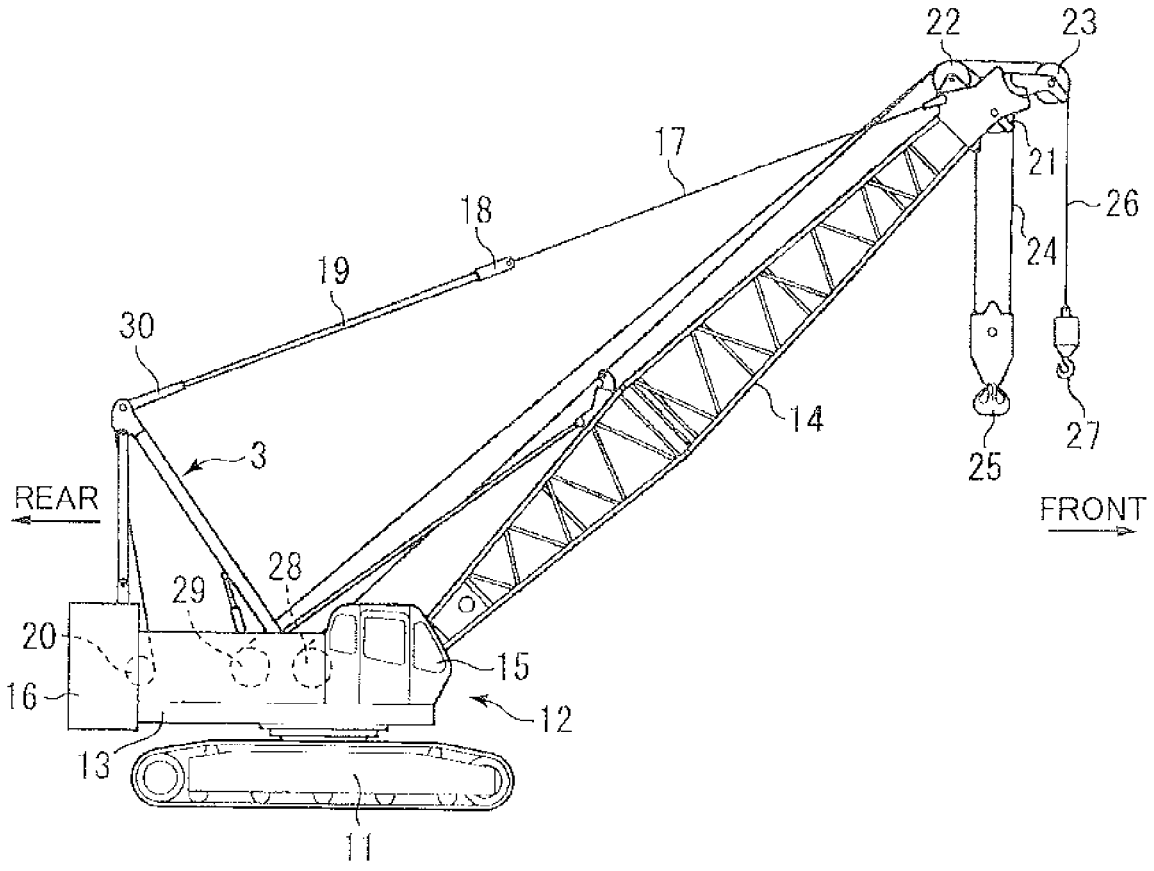
FIG. 1 is a schematic side view of a crawler crane as a construction machine according to an embodiment of the present invention.

As shown in FIG. 1, the crawler crane 1 includes a crawler-type lower travelling body 11, an upper slowing body 12 slewably mounted on the lower travelling body 11, and a boom 14 as a work attachment.

The upper slowing body 12 includes a slewing frame 13 as a base. The boom 14 is attached to a front portion of the slowing frame 13 so as to be capable of being raised and lowered relatively to the slewing frame 13. The base is net particularly specified with respect to its mode, shape, and size. The base may be plate-shaped or frame-shaped.

The upper slewing body 12 further includes a cab 15 (driving room) installed on the front portion of the slowing frame 13, a gantry 3 installed over a rear portion of the slowing frame 13, and a counterweight 16 joined to a rear end of the slowing frame 13.

The following description includes front, rear, left and right which are defined with reference to the base that is slowed relatively to the lower travelling body 11. As shown in FIG. 1, rearward is a direction in which a below-described front leg 4 of the gantry 3 is lowered, and frontward is a direction opposite thereto. Leftward and rightward are defined on the basis of the "forward" as defined above.

The crawler crane 1 further includes a boom guy line 17, an upper spreader 18, a boom raising-lowering rope 19, a lower spreader 30, and a boom raising-lowering drum 20. The boom guy line 17 includes a first end portion fixed at a distal end portion of the boom 14 and a second end portion connected to the upper spreader 18 on the side opposite to the first end portion. The gantry 3 has a shape including an apex portion, at which the lower spreader 30 is provided. The boom raising-lowering rope 19 is wound between the upper spreader 18 and the lower spreader 30. The boom raising-lowering rope 19 includes a proximal end fixed to the gantry 3 and a section on a distal-end side of the proximal end, the section being wound around the boom raising-lowering drum 20. The boom raising-lowering drum 20 is installed on the rear portion of the slewing frame 13 and is configured to rotate so as to wind and unwind the boom raising-lowering rope 19, thereby increasing and decreasing a distance between the lower spreader 30 and the upper spreader 18 to raise and lower the boom 14.

In the distal end portion of the boom 14, there are rotatably provided boom point sheaves 21, idler sheaves 22, and auxiliary sheaves 23. A main hook 25 is suspended from the boom point sheaves 21 through a main hoist rope 24, and an auxiliary hook 27 is suspended from the auxiliary sheaves 23 through an auxiliary hoist rope 26.

On the slowing frame 13, a main hoist drum 28, an auxiliary hoist drum 29, and the boom raising-lowering drum 20 are arranged in this order from the front side. Each of the drums 28, 29, 20 includes a drum rotation shaft, being attached to the clewing frame 13 in a laterally-placed attitude where the drum rotation shaft extends in a left-right direction.

The main hoist rope 24 includes a distal end fixed to the boom 14 and a section on a proximal end side of the distal end, the section being supported by the boom point sheaves 21 and the idler sheaves 22 and wound around the main hoist drum 28. The main hoist drum 28 rotates to lift and lower the main hook 25 through the main hoist rope 24.

The auxiliary hoist rope 26 includes a distal end fixed to the auxiliary hook 27 and a section on a proximal end side of the distal end, the section being supported by the auxiliary sheaves 23 and is wound around the auxiliary hoist drum 29.

The auxiliary hoist drum 29 rotates to lift and lower the auxiliary hook 27 through the auxiliary hoist rope 26.

Figure 2:
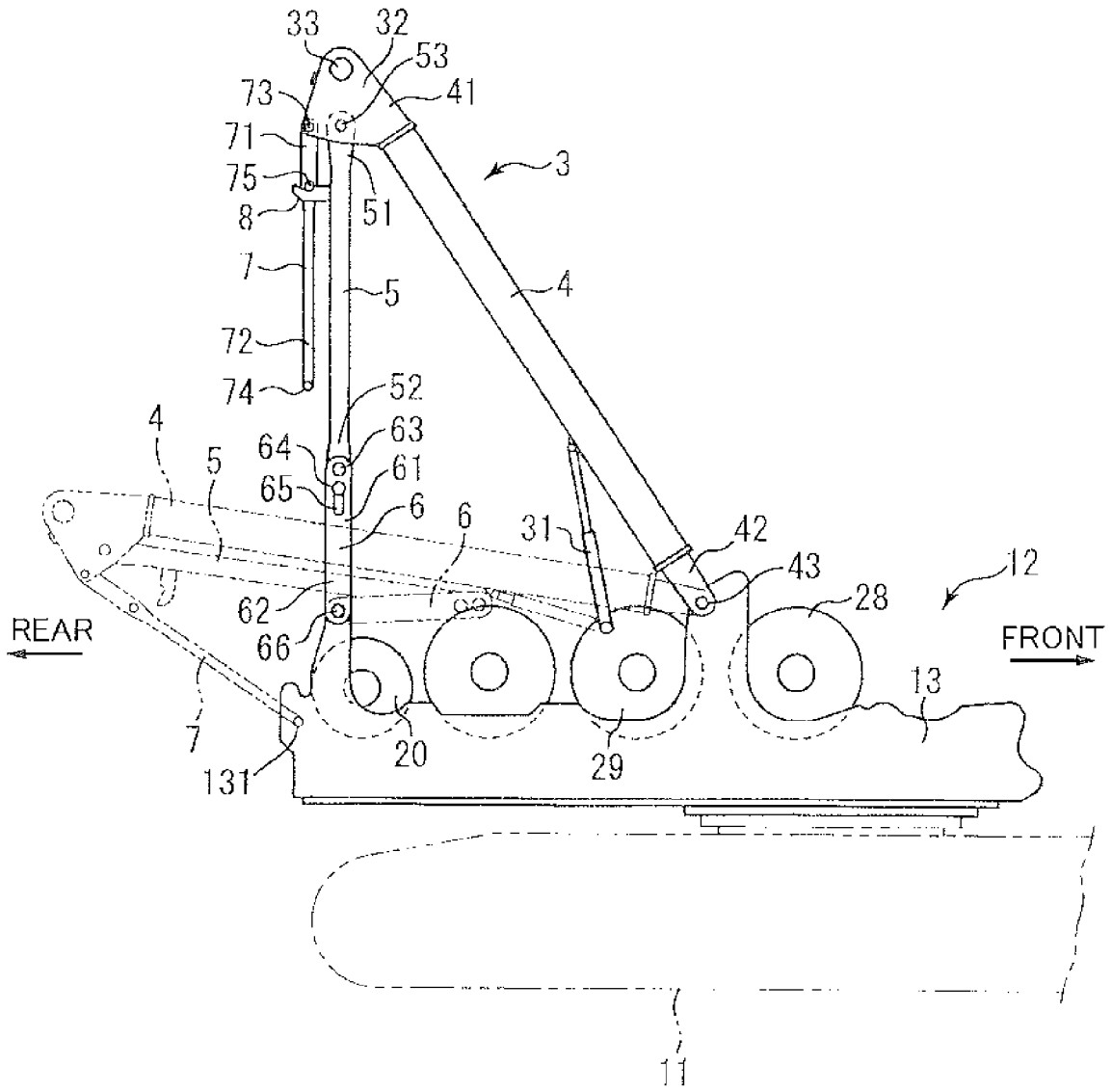
FIG. 2 is a side view showing a gantry of the crawler crane and peripheral elements of the gantry.

As shown in FIG. 2. the gantry 3 includes a pair of left and right front legs 4, a pair of left and right upper rear legs 5, a pair of left and right lower rear legs 6, and a pair of left and right front-rear interconnection sections 32.

Each of the pair of front legs 4 includes a lower end portion 42, which is a proximal end portion rotatably connected to the slewing frame 13 as the base so as to allow the front leg 4 to be raised and lowered, and an upper end portion 41, which is a movable end portion opposite to the lower end portion 42. In the present embodiment, the lower end portion 42 of the front leg 4 is connected to the slewing frame 13 rotatably around a support shaft 43 formed of a pin or the like, thereby allowing the front leg 4 to be supported by the slowing frame 13. However, means for rotatably connecting the front leg 4 to the base is not limited.

The upper rear leg 5 includes an upper end portion 51, which is a first upper end portion oriented upward in the working state, and a lower end portion 52, which is a first lower end portion opposite to the upper end portion 51. The upper end portion 51 is rotatably connected to the upper end portion 41 of the opposite end portions of the front leg 4, the upper end portion being oriented upward in the working state. In the present embodiment, the upper end portion 51 of the upper rear leg 5 is connected to the upper end portion 41 of the front leg 4 rotatably around a support shaft 53 formed of a pin or the like. However, means for rotatably connecting the upper rear leg 5 to the front leg 4 is not limited.

The lower rear leg 6 includes an upper end portion 61, which is a second upper end portion oriented upward in the working state, and a lower end portion 62, which is a second lower end portion opposite to the upper end portion 61. The upper end portion 61 is rotatably connected to the lower end portion 52 of the opposite end portions of the upper rear leg 5, the lower end portion 52 being oriented downward in the working state. The lower end portion 62 of the opposite end portions of the lower rear leg 6, being oriented downward in the working state, is rotatably connected to a rear support portion of the slowing frame 13 as the base, the rear support portion being located on a rear side of a front support portion to which the lower end portion 42 of the front leg 4 is connected. In the present embodiment, the upper end portion 61 of the lower rear leg 6 is connected to the lower end portion 52 of the upper rear leg 5 through two connection pins 63, 64 that are aligned above and below. The lower end portion 62 of the lower rear leg 6 is supported by the rear support portion of the slowing frame 13, the rear support portion being on a rear side of the front support portion to which the lower end portion 42 of the front leg 4 is connected, rotatably around a support shaft 66 formed of a pin or the like. However, means for rotatably connecting the lower rear leg 6 to the upper rear leg 5 and the base (the stewing frame 13 in the present embodiment) are not limited.

Of the two top and bottom connection pins 63, 64 that interconnect the upper rear leg 5 and the lower rear leg 6, the upper connection pin 63 is inserted into a First pin insertion hole provided in the upper rear leg 5 and into a second pin insertion hole provided in the lower rear leg 6, in a state where the first and second pin insertion holes coincide with each other. The lower connection pint 64 is inserted into a third pin insertion hole provided in the upper rear leg 5 and into an upper end portion of a long hole 65 provided in the lower rear leg 6, in a state where the third pin insertion hole and the upper end portion of the long hole 65 coincide with each other.

The working state of the gantry 3 is indicated by a solid line in FIG. 2. In the working state, the upper rear leg 5 and the lower rear leg 6 extend substantially vertically, and the front leg 4 is inclined obliquely downward and forward. It is not necessary that respective longitudinal directions of the upper rear leg 5 and the lower rear leg 6 coincide strictly with a vertical direction in the working state; the longitudinal directions may be inclined by about 20 degrees to the vertical direction, for example. Each of the longitudinal direction of the upper rear leg 5 and the longitudinal direction of the lower rear leg 6 does not have to be straight. The angle formed by the longitudinal direction of the upper rear leg 5 and the longitudinal direction of the lower rear leg 6 is not limited to 180 degrees.

The stored state of the gantry 3 is indicated by a dashed-two dotted line in FIG. 2. In the stored state, the connection pin 63 is removed from the upper rear leg 5 and the lower rear leg 6, and the upper rear leg 5 and the lower rear leg 6 are lowered while being folded so as to locate the lower end portion 52, which is the first lower end portion of the upper rear leg 5, on a front side of the upper end portion 51, which is the first upper end portion, and so as to locate the upper end portion 62, which is the second upper end portion of the lower rear leg 6, on a front side of the lower end portion 61, which is the second lower end portion. Furthermore, the front leg 4 is lowered onto the thus folded upper rear leg 5 so as to locate the upper end portion 41, which is the movable end portion of the front leg 4, on a rear side of the lower end portion 42, which is the proximal end portion.

In the stored state, the angle formed by the longitudinal direction of the upper rear leg 5 and the longitudinal direction of the lower rear leg 6 is not limited to 0 degrees.

The gantry 3 further includes a hydraulic cylinder 31 interposed between a lower portion of the front leg 4 and the slewing frame 13. The hydraulic cylinder 31 makes extending and contracting actions to thereby rotate the front leg 4 of the gantry 3 around the support shaft 43. In the present embodiment, the extending action of the hydraulic cylinder 31 involves a rotation of the front leg 4 in a rising direction. The pair of left and right front-rear interconnection sections 32 interconnect the pair of left and right front legs 4 and the pair of upper rear legs 5, respectively. Across the pair of left and right front-rear interconnection sections 32, a connection shaft 33 is disposed, extending in the left-right direction, and the lower spreader 30 is attached to the connection shaft 33.

The gantry 3 further includes a pair of left and right connection members 7. The pair of connection members 7 connect the pair of front-rear interconnection sections 32 to the base, respectively, in the stored state to thereby keep the stored state. It is also permissible to provide only one of the left and right connection members 7.

The front-rear interconnection section 32 according to the present embodiment is integrally fixed to the front leg 4, while being connected to the upper rear leg 5 so as to be rotatable relatively thereto. The front-rear interconnection section 32, alternatively, may be integrally fixed to the upper rear leg 5, or may be configured as a link member capable of making rotational movement relatively to each of the front leg 4 and the upper rear leg 5.

Each of the pair of connection members 7 includes a rod-shaped connection-member main body 70. The connection-member main body 70 according to the present embodiment includes a pair of long plate parts and a spacer interposed between the two long plate parts. However, the specific shape of the connection-member main body 70 is not limited.

The connection member 7 includes a first connection end portion and a second connection end portion, which are longitudinal opposite end portions. In the present embodiment, the first connection end portion is a lower end portion 72, and the second connection end portion is an upper end portion 71. The upper end portion 71 is connected to the upper rear leg 5 so as to allow the lower end portion 72 to rotate in a direction of moving toward or away from the upper rear leg 5. The upper end portion 71, which is the second connection end portion, is connected to the front-rear interconnection section 32. Specifically, the front-rear interconnection section 32 includes a part located on a rear side of the upper end portion 51, which is the first upper end portion of the upper rear log 5, and the upper end portion 71 is connected to the part. In the present embodiment, the upper end portion 71 is connected to a part of the front-rear interconnection section 32, the part being on a rear side of the support shaft 53, which is a interconnection point of the front-rear interconnection section 32 and the upper rear leg 5, so as to be rotatable around a support shaft 73 formed of a pin or the like.

In detail, at least one of the upper end portion 71 of the connection member 7 and the front-rear interconnection section 32 is formed with an insertion hole, into which the support shaft 73 is inserted. However, means for rotatably connecting the connection member 7 to the front-rear interconnection section 32 is not limited.

The lower end portion 72, which is the first connection end portion of the connection member 7, includes a first storage connection portion connected to a second storage connection portion to keep the stored state, the second storage connection portion being a part of one of the upper rear leg 5, the lower rear leg 6, and the slewing frame 13 as the base. In the present embodiment, the lower end portion 72 of the connection member 7 is formed with a pin insertion hole 74, which is the first storage connection portion. Resides, the second storage connection portion according to the present embodiment is a pin insertion hole 131 formed in the slewing frame 13 as the base.

The pin insertion holes 74, 131 are capable of coinciding with each other when the connection member 7 rotates around the upper end portion 71 to form a predetermined angle between the connection member 7 and the base in the stored state, and a pin is inserted in both of the pin insertion holes 74, 131 in the coinciding state to thereby interconnect the connection member 7 and the clewing frame 13 (that is the base). The interconnection fixes relative positional relationships of the front leg 4, the upper rear leg 5, the lower rear leg 6, and the connection member 7 to keep the stored state. Specific modes of the first and second storage connection portions are not limited.

Removal of the pin from the pin insertion holes 74, 131 to release the interconnection of the first and second storage connection portions allows the gantry 3 to make transition from the stored state to the working state. However, since the connection member 7 is rotatable around the upper end portion 71, the transition of the gantry 3 to the working state without fixing the connection member 7 causes the connection member 7 to swing to collide against the upper rear leg 5 or the like, thereby generating the possibility of damage in the paint on the upper rear leg 5 or the connection member 7 or occurrence of collision sound.

Figure 3:
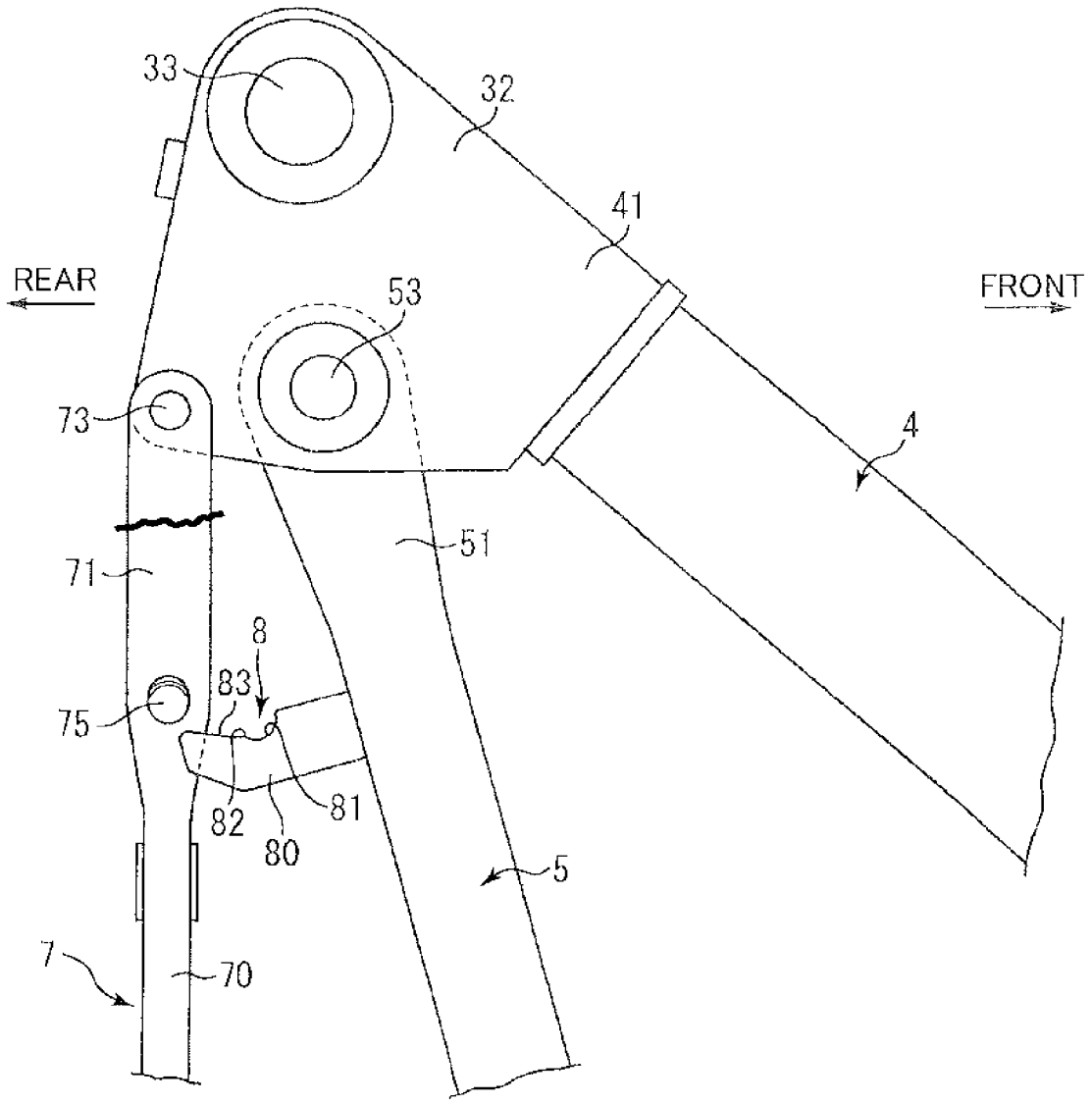
FIG. 3 is a partially broken-away side view showing a state before a shaft section is held by a shaft holding portion of the gantry.

To prevent the connection member 7 from thus swinging, the connection member 7 includes, as shown in FIG. 3, a shaft section 75 in addition to the connection-member main body 70, and the upper rear leg 5 includes a shaft holding portion 8 for holding the shaft section 75.

The shaft section 75 is provided at any part of the connection member 7. The shaft section 75 protrudes beyond the connection-member main body 70 in an axial direction, which is a direction orthogonal to the longitudinal direction of the connection-member main body 70 and orthogonal to the direction in which the connection member 7 moves toward or away from the upper rear leg 5; in the present embodiment, the axial direction corresponds to the left-right direction of the gantry 3.

In the present embodiment, each of the plate parts constituting the connection member 70 is formed with an insertion hole in an upper portion of the connection-member main body 70. The shaft section 75 is formed of a circular columnar pin, being inserted in each of the insertion holes with a play to be thereby installed across the pair of plate parts in a state of doubly supported beam. The play allows the shaft section 75 to move by a predetermined distance in a rotation radial direction of the connection member 7 (in the present embodiment, the longitudinal direction of the connection-member main body 70) relatively to the shaft holding portion 8. The shaft section 75 may have a circular cylindrical shape instead of a circular columnar shape. The shaft section 75 may have a rectangular cross section instead of circular one, The shaft section 75 is not limited with respect to its shape, size, material and the like. The shaft section 75 may be supported by the connection-member main body 70 in a slate of cantilever.

In the present embodiment, the shaft holding portion 8 is formed of a lock plate 80. The lock plate 80 is connected to an upper portion of the upper rear leg 5 and, in the working state, protrudes rearward beyond the upper rear leg 5. The lock plate 80 is located at a position offset to the left or right from rotation tracks of the pair of plate parts forming the connection-member main body 70, that is, at a position between the pair of plate parts in the present embodiment, thereby making no interference with the connection-member main body 70.

Figure 4:
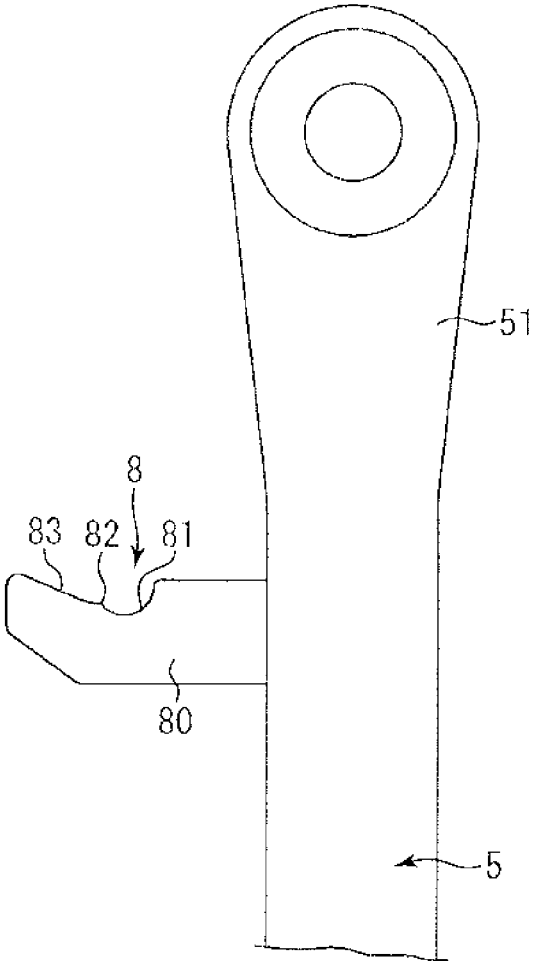
FIG. 4 is a side view showing the shaft holding portion and peripheral elements of the shaft holding portion.

As shown in FIG. 4. the shaft holding portion 8 includes a shaft holding surface 81, a dislodgement prevention portion 82, and a guide portion 83.

The shaft holding surface 81 is a surface protruding rearward from the upper rear leg 5 in the working state where the upper rear leg 5 and the lower rear leg 6 extend substantially vertically to receive the lower end portion of the shaft section 75 of the connection member 7 suspended by its own weight from the upper end portion 71, which is the second connection end portion as a rotation center. The shaft holding surface 81 according to the present embodiment is formed by a part of an upper surface of the lock plate 80, at such a position that the shaft holding surface 81, in the working state, conies into contact with the lower end portion of the shaft section 75 of the connection member 7 that is suspended by its own weight. The shaft holding surface 81 preferably has a shape corresponding to a shape of the lower end portion of the shaft section 75 so as to be capable of fitting with the lower end portion, specifically, an arc shape opened upward when axially seen in the example shown in FIG. 3.

The dislodgement prevention portion 82 protrudes upward beyond the shaft holding surface 81 at a position on a rear side of the shaft holding surface 81, thereby restricting movement of the shaft section 75 to the rear side to prevent the shaft section 75 from being dislodged from the shaft holding surface 81. The dislodgement prevention portion 82 according to the present embodiment is formed by an edge protruding upward so as to define a rear end of the shaft holding surface 81 in an upper surface of the lock plate 80.

The guide portion 83 is a surface located on a rear side of the dislodgement prevention portion 82 and inclined downward toward a front side. The guide portion 83 comes into contact with the lower end portion of the shaft section 75 of the connection member 7 suspended by its own weight from the upper end portion 71, which is the second connection end portion, during the transition from a posture where the upper rear leg 5 and the lower rear leg 6 are lowered and folded, namely, the posture in the stored state, to a posture where the upper rear leg 5 and the lower rear leg 6 are raised and extended substantially vertically, namely, the posture in the working state, thereby guiding the shaft section 75 to the dislodgement prevention portion 82 and the shaft holding portion 81.

Next will be described details of holding of the shaft section 75 by the shaft holding portion 8.

The rotation of the upper rear leg 5 in the direction of raising of the upper rear leg S and the lower rear leg 6 from the stored state involves rearward movement of the guide portion 83 of the shaft holding portion 8 provided in the upper rear leg 5. As shown in FIG. 3, this movement causes the lock plate 80 forming the shaft holding portion 8 to be inserted between the pair of plate parts forming the connection-member main body 70. FIG. 3 and FIGS. 5 to 8 show, in a broken-away manner, a part of the plate portion (the shaft section 75 and a part where the shaft holding portion 8 is inserted), of the pair of plate parts forming the connection-member main body 70, on the front side on the page.

Figure 5:
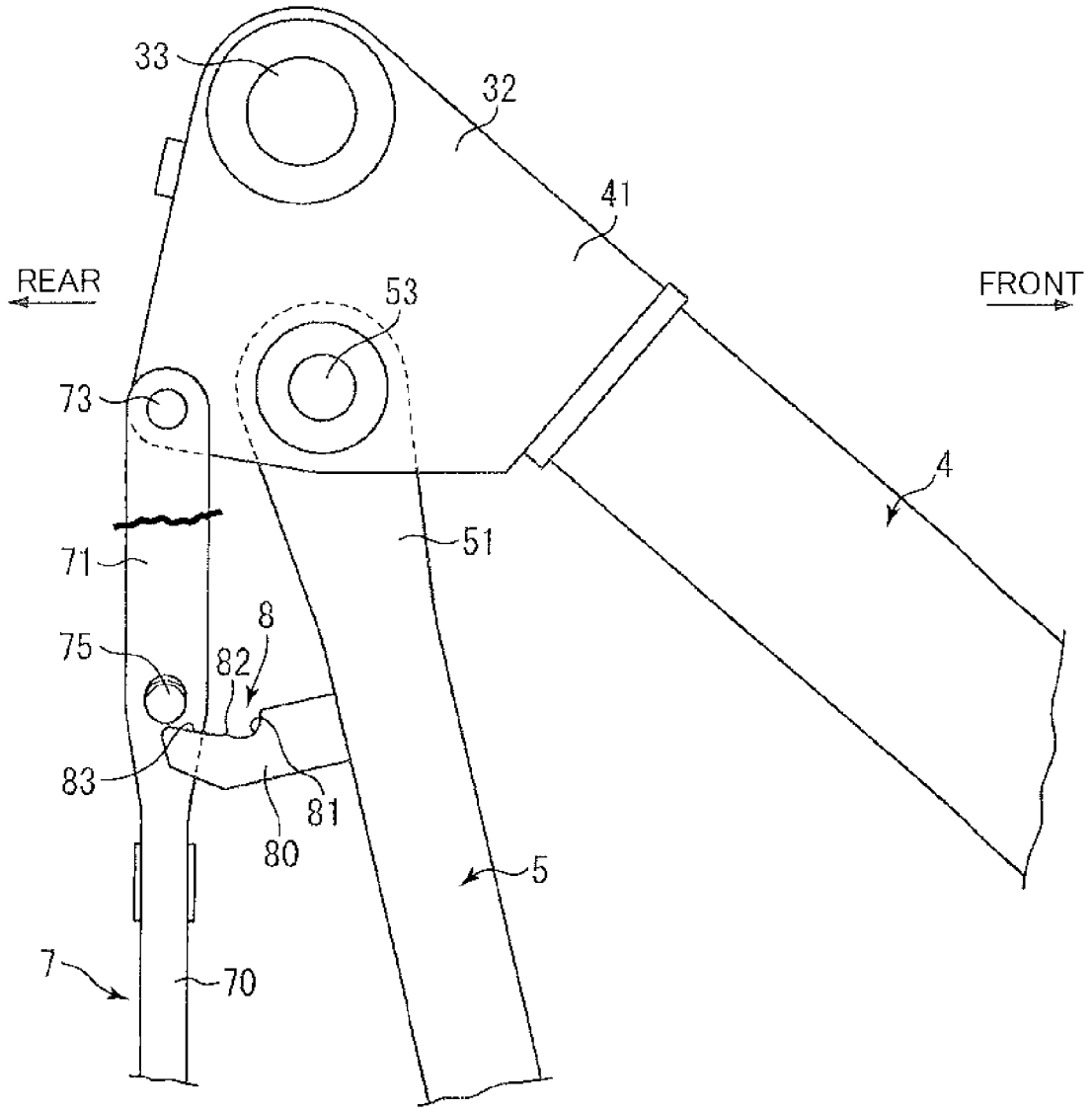
FIG. 5 is a partially broken-away side view showing a state before the shaft section is held by the shaft holding portion.
Figure 6:
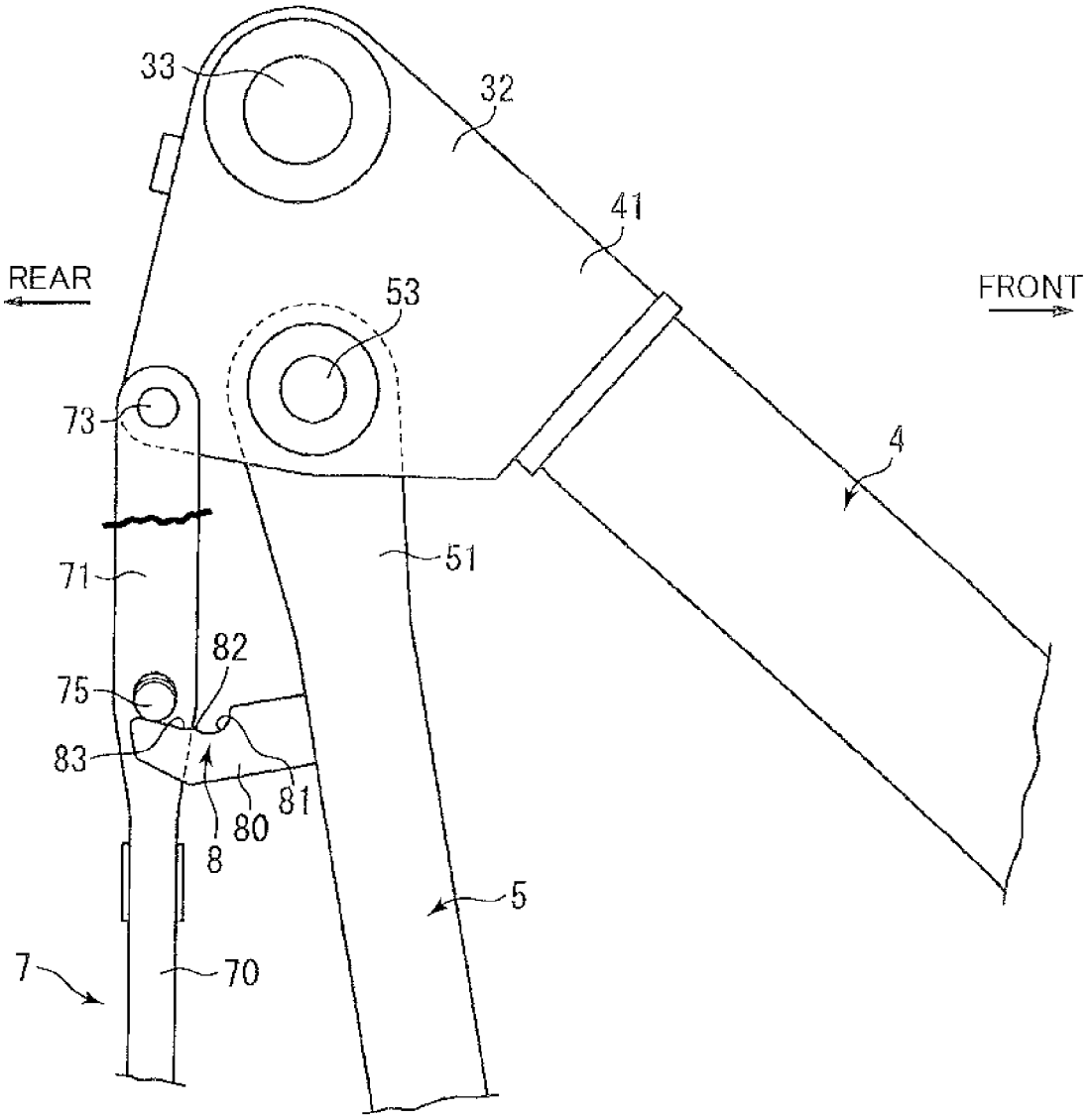
FIG. 6 is a partially broken-away side view showing a state where the shaft section has conic contact with a guide portion of the shaft holding portion.

As shown in FIG. 5, the guide portion 83 comes into contact with the lower end portion of the shaft section 75 of the connection member 7 suspended by its own weight, and further, as shown in FIG. 6, supports the lower end portion of the shaft section 75 while moving rearward. At this time, the part of the guide portion 83 in contact with the shaft section 75, since being inclined forward, applies a forward force to the shaft section 75.

Figure 7:
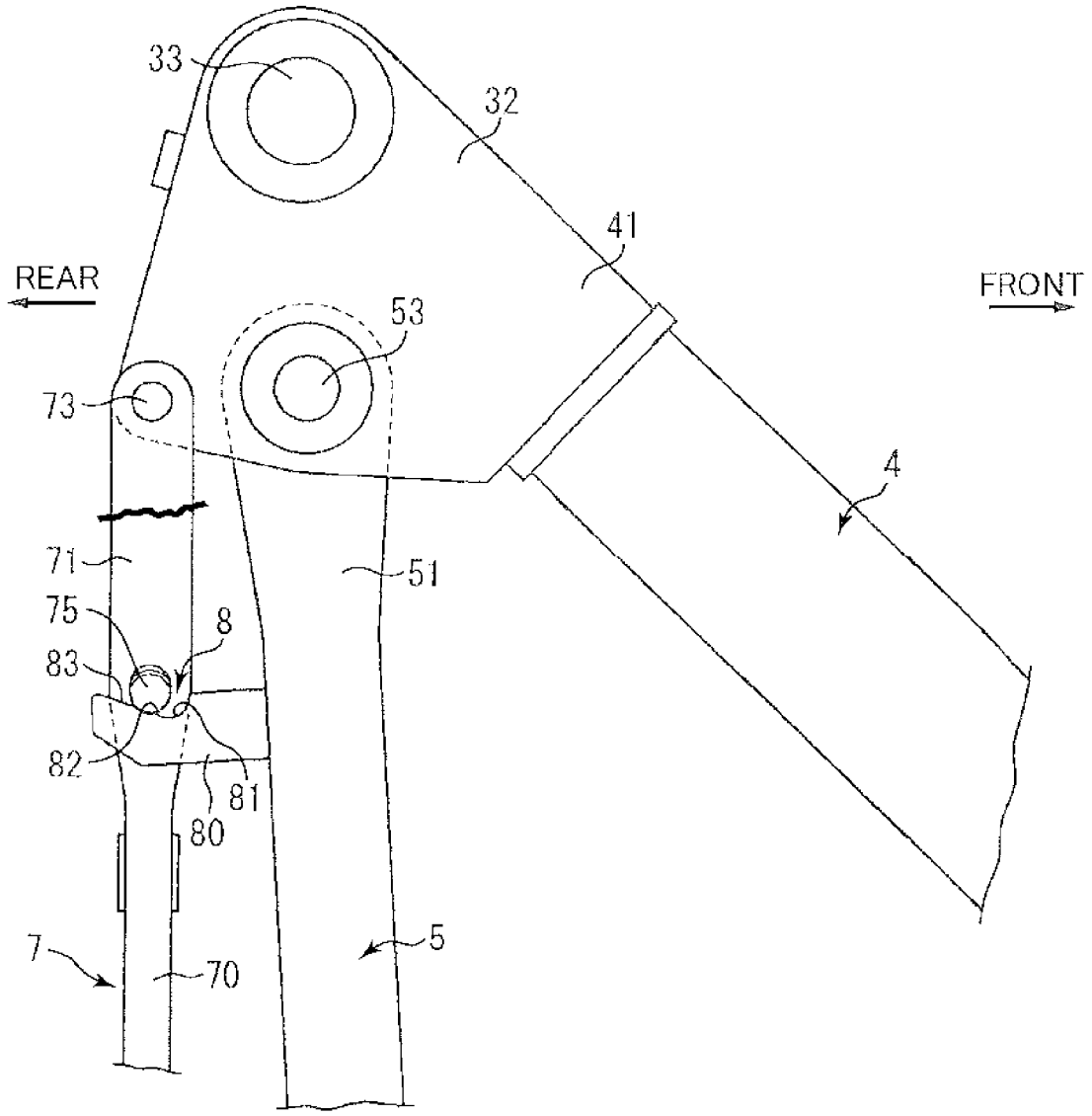
FIG. 7 is a partially broken-away side view showing a state immediately before the shaft section climbs over a dislodgement prevention portion of the shaft holding portion.

The guide portion 83 thereafter moves further rearward and applies the forward force to the shaft section 75 while supporting the shaft section 75, thereby causing the shaft section 75 to climb over the dislodgement prevention portion 82 as shown in FIG. 7. The shaft section 75, which is capable of displacement relative to the connection-member main body 70 within the range of the play of the shaft section 75 in the longitudinal direction of the connection-member main body 70, that is, the rotation radial direction of the connection member 7 as described above, can climb over the dislodgement prevention portion 82 through its slight relative displacement upward in the longitudinal direction of the connection member 7 to the connection-member main body 70.

Figure 8:
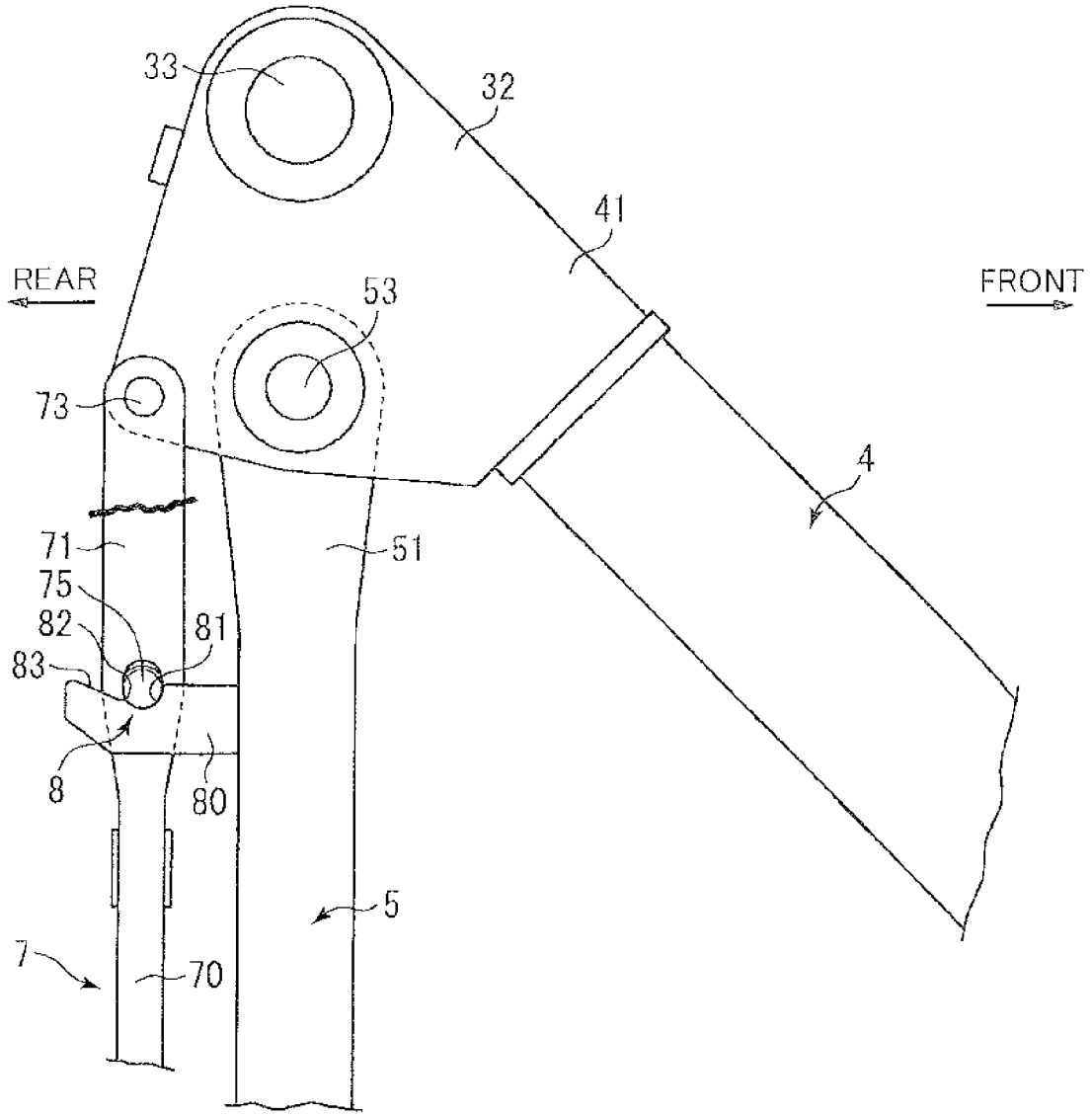
FIG. 8 is a partially broken-away side view showing a state where the shaft section is held on a shaft holding surface of the shaft holding portion.
Figure 9:
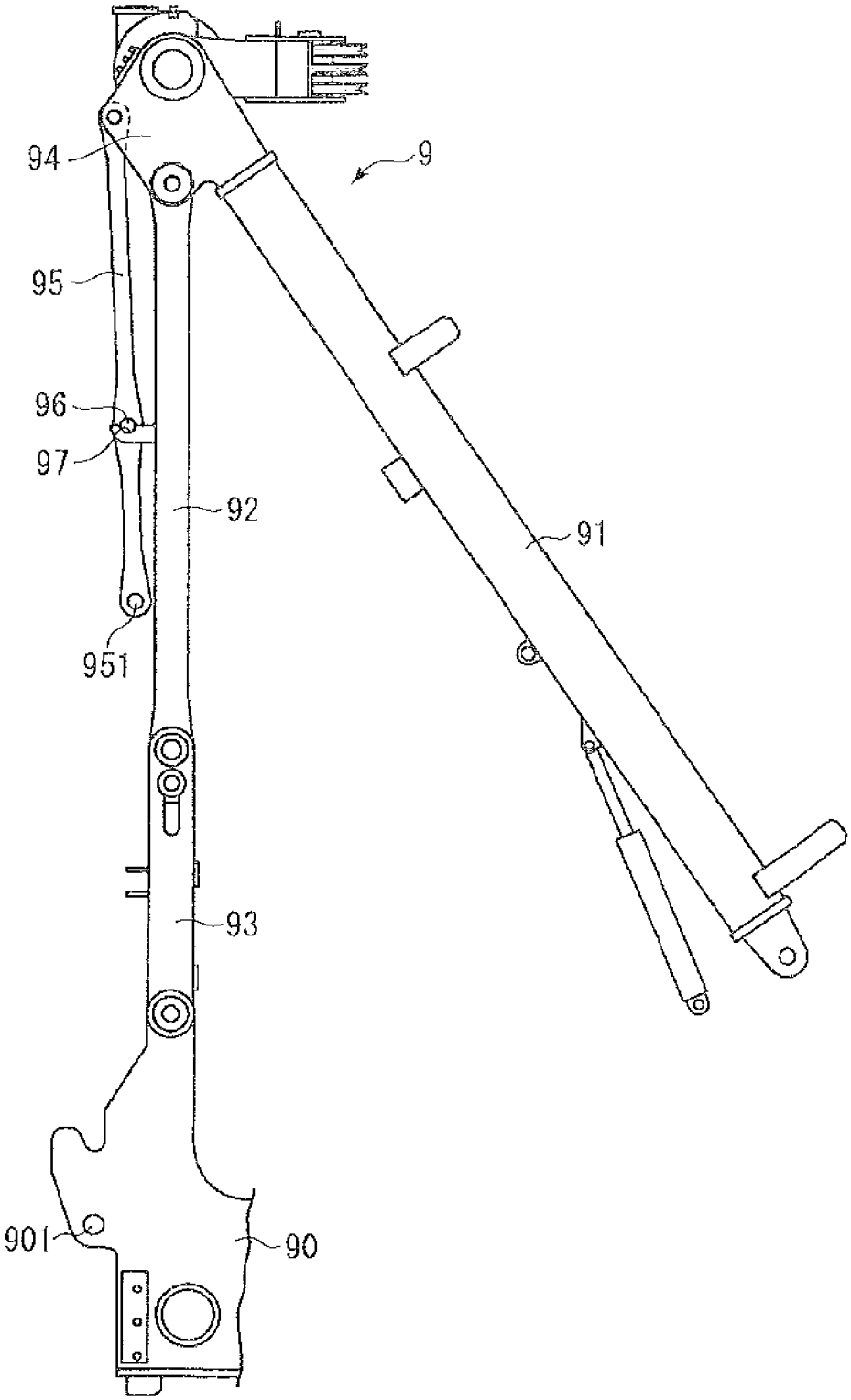
FIG. 9 is a side view of a gantry for a conventional crawler crane and peripheral elements of the gantry.
Figure 10:
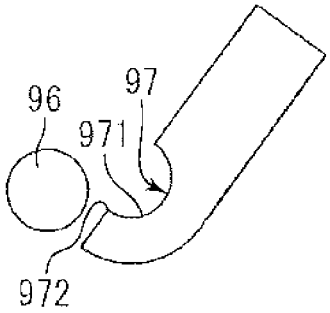
FIG. 10 is a side view of a shaft holding portion of the gantry shown in FIG. 9.

The shaft section 75 thus having climbed over the dislodgement maintaining section 82 is, as shown in FIG. 8, lowered relatively to the connection-member main body 70 due to the weight of the shaft section 75, thereby being received and held by the shaft holding surface 81. This hold restrains the connection member 7 from relative rotation to the upper rear leg 5 around the upper end portion 71, thereby hindering the connection member 7 from collision against the upper rear leg 5 or the like due to swinging of the connection member 7 to prevent a damage in paint on the upper rear leg 5 or the connection member 7 or occurrence of collision sound.

The above-described series of motions of the shaft section 75 with respect to the shaft holding portion 8, that is, the motion of climbing over the dislodgement prevention portion 82 through the guide by the guide portion 83 to reach the shaft holding surface 81, is automatically performed involved by the transition of the gantry 3 from the stored state to the working state caused by the extension of the hoist cylinder 31. This eliminates necessity for manually making the shaft holding surface 81 hold the shaft section 75.

The higher the position of the shaft section 75 in the connection member 7 and the position of the shaft holding portion 8 in the upper rear leg 5 in the working state, the more preferable. In the present embodiment, the shaft section 75 is provided at such a position that the distance between the shaft section 75 and the upper end portion 71, which is the second connection end portion of the connection member 7, is smaller than the distance between the shaft section 75 and the lower end portion 72, which is the first connection end portion of the connection member 7, and correspondingly, the shaft holding portion 8 is provided at such a position that the distance between the shaft holding portion 8 and the upper end portion 51, which is the first upper end portion of the upper rear leg 5, is smaller than the distance between the shaft holding portion 8 and the lower end portion 52, which is the first lower end portion of the upper rear leg 5. This allows the length of protrusion of the shaft holding portion 8 beyond the upper rear leg 5 to be reduced. That is because the closer the shaft section 75 is to a rotation center of the connection member 7, the smaller the movement distance of the shaft section 75 is, which allows the length of the protrusion of the guide portion 83 beyond the upper rear leg 5, which is required for the guide portion 83 enough to guide the shaft section 75 to be small.

On the other hand, during the transition from the working state to the stored state, the inclination of the upper rear leg 5 and the shaft holding portion 8 involves a slight relative displacement of the shaft section 75 of the connection member 7 to the connection-member main body 70, in a direction of approaching the upper end portion 71, which is the second connection end portion of the connection member 7, thereby causing the shaft section 75 to climb over the dislodgement prevention portion 82 to be dislodged from the shaft holding surface 81. Thus is automatically released the hold of the shaft section 75 by the shaft holding portion 8, that is, the hold of the connection member 7 by the upper rear leg 5. This eliminates the necessity for manually releasing the holding of the connection member 7 by the upper rear leg 5. Furthermore, the upper rear leg 5, the lower rear leg 6, the connection member 7, and the like are prevented from damage due to their mutual collisions caused by forgotten release of the holding.

Each of the front leg 4, the upper rear leg 5, the lower rear leg 6, and the connection member 7 according to the present embodiment is formed of a rod-shaped member. The front leg 4, the upper rear leg 5, the lower rear leg 6, and the connection member 7, however, only have to constitute, as a whole, a link mechanism capable of making motions as described above, their shapes and structures being not limited. For example, each may be formed of one or a plurality of, for example, plate-shaped members. Each of the front leg 4, the upper rear leg 5, the lower rear leg 6, and the connection member 7, though being straight in the embodiment, may include a curved part or be entirely gently curved.

The shaft section according to the present invention only has to be displaceable relatively to the shaft holding portion in the rotation radial direction of the connection member to a degree enough to climb over the dislodgement maintaining section. For example, instead of or in addition to the insertion of the shaft section 75 with a play into the insertion hole formed at the upper portion of the connection member 7 as in the embodiment described above, the support shaft 73 may be inserted, with a play, in the insertion hole formed to at least one of the upper end portion 71 of the connection member 7 or the front-rear interconnection section 32 to thereby allow the entire connection member 7 to be displaced, within a predetermined distance, in the rotation radial direction of the connection member 7, relatively to the shaft holding portion 8.

As described above, provided is a gantry for a construction machine, the gantry being capable of transition from a stored state to a working state and enabling a connection member for keeping the stored state to be easily restrained from swinging in the working state. Provided is a gantry installed on a base of a construction machine, the gantry including: a front leg including a proximal end portion rotatably connected to a front support portion of the base so as to be able to be raised and lowered relatively to the base and a movable end portion opposite to the proximal end portion; an upper rear leg including a first upper end portion rotatably connected to the movable end portion of the front leg and a first lower end portion opposite to the first upper end portion; a lower rear leg including a second upper end portion rotatably connected to the first lower end portion of the upper rear leg and a second lower end portion rotatably connected to a rear support portion of the base, the rear support portion being a portion located on a rear side of the front support portion; a front-rear interconnection section interconnecting the movable end portion of the front leg and the first upper end portion of the upper rear leg, the front-rear interconnection section being rotatably connected to at least one of the movable end portion and the first upper end portion; and a connection member. The gantry is capable of transition between a working state in which the upper rear leg and the lower rear leg extend substantially vertically and the front leg is inclined obliquely downward and forward and a stored state in which the upper rear leg and the lower rear leg are lowered while being folded so as to locate the first lower end portion of the upper rear leg on a front side of the first upper end portion and so as to locate the second upper end portion of the lower rear leg on a front side of the second lower end portion, and the front leg is lowered onto the upper rear leg having been folded. The connection member is provided to connect the front-rear interconnection section to the base to keep the stored state, including a first connection end portion and a second connection end portion that are longitudinal opposite end portions of the connection member, the second connection end portion being connected to a connection part of the interconnection section, the connection part being located on a rear side of the first upper end portion of the upper rear leg, so as to allow the first connection end portion to rotate in a direction of moving toward or away from the upper rear leg. The first connection end portion includes a first storage connection portion configured to be connected to a second storage connection portion to keep the stored state, the second storage connection portion being a portion of one of the upper rear leg, the lower rear leg, and the base. The connection member includes a connection-member main body including the first connection end portion and the second connection end portion, and a shaft section protruding beyond the connection-member main body in an axial direction that is a direction orthogonal to a longitudinal direction of the connection member and orthogonal to the direction of moving toward or away from the upper rear leg, at a position between the first connection end portion and the second connection end portion in the connection-member main body. The upper rear leg includes a shaft holding portion that protrudes rearward from the upper rear leg and holds the shaft section in the working state, and the shaft holding portion includes a shaft holding surface that receives a lower end portion of the shaft section of the connection member that is suspended by a weight of the connection member from the second connection end portion that is a rotation center, a dislodgement prevention portion located on a rear side of the shaft holding surface and above the shaft holding surface and configured to restrain the shaft section from rearward movement to prevent the shaft section from being dislodged from the shaft holding surface, and a guide portion located on a rear side of the dislodgement prevention portion and configured to come into contact with the lower end portion of the shaft section of the connection member that is suspended by the weight of the connection member from the second connection end portion when the upper rear leg and the lower rear leg are raised to extend substantially vertically from a state where the upper rear leg and the lower rear leg are lowered and folded, the guide portion being inclined downward and frontward so as to guide the shaft section to the shaft holding surface. A part of the connection member which part includes at least the shaft section is capable of relative displacement to the shaft holding portion in a rotation radial direction of rotation of the connection member around the second connection end portion, the relative displacement allowing the shaft section to climb over the dislodgement prevention portion.

This gantry, during transition from the stored state to the working state, allows the shaft section of the connection member to be automatically guided to the dislodgement prevention portion by the guide portion of the shaft holding portion and to climb over the dislodgement prevention portion through the relative displacement of the shaft section in the rotation radial direction of the connection member to the shaft holding portion, to be thereby automatically held on the shaft holding surface of the shaft holding portion.

The shaft section is preferably provided at such a position in the connection member that a distance between the shaft section and the second connection end portion is smaller than a distance between the shaft section and the first connection end portion, and the shaft holding portion is preferably provided at such a position in the upper rear leg that a distance between the shaft holding portion and the first upper end portion is smaller than a distance between the shaft bolding portion and the first lower end portion. This makes it possible to make the length of rearward protrusion of the shaft holding portion beyond the upper rear leg be small.

The invention claimed is:

1. A gantry provided on a base of a construction machine, the gantry comprising:

a front leg including a proximal end portion rotatably connected to a front support portion of the base so as to be able to be raised and lowered relatively to the base and a movable end portion opposite to the proximal end portion;

an upper rear leg including a first upper end portion rotatably connected to the movable end portion of the front leg and a first lower end portion opposite to the first upper end portion;

a lower rear leg including a second upper end portion rotatably connected to the first lower end portion of the upper rear leg and a second lower end portion rotatably connected to a rear support portion of the base, the rear support portion being a portion located on a rear side of the front support portion;

a front-rear interconnection section interconnecting the movable end portion of the front leg and the first upper end portion of the upper rear leg, the front-rear interconnection section being rotatably connected to at least one of the movable end portion and the first upper end portion; and a connection member, wherein:

the gantry is capable of transition between a working state in which the upper rear leg and the lower rear leg extend substantially vertically and the front leg is inclined obliquely downward and forward and a stored state in which the upper rear leg and the lower rear leg are lowered while being folded so as to locate the first lower end portion of the upper rear leg on a front side of the first upper end portion and so as to locate the second upper end portion of the lower rear leg on a front side of the second lower end portion, and the front leg is lowered onto the upper rear leg having been folded;

the connection member is provided to connect the front-rear interconnection section to the base to keep the stored state, including a first connection end portion and a second connection end portion that are longitudinal opposite end portions of the connection member, the second connection end portion being connected to a connection part of the interconnection section, the connection part being located on a rear side of the first upper end portion of the upper rear leg, so as to allow the first connection end portion to rotate in a direction of moving toward or away from the upper rear leg;

the first connection end portion includes a first storage connection portion configured to be connected to a second storage connection portion to keep the stored state, the second storage connection portion being a portion of one of the upper rear leg, the lower rear leg, and the base;

the connection member includes a connection-member main body including the first connection end portion and the second connection end portion, and a shaft section protruding beyond the connection-member main body in an axial direction that is a direction orthogonal to a longitudinal direction of the connection member and orthogonal to the direction of moving toward or away from the upper rear leg, at a position between the first connection end portion and the second connection end portion in the connection-member main body;

the upper rear leg includes a shaft holding portion that protrudes rearward from the upper rear leg and holds the shaft section in the working state, and the shaft holding portion includes a shaft holding surface that receives a lower end portion of the shaft section of the connection member that is suspended by a weight of the connection member from the second connection end portion that is a rotation center, a dislodgement prevention portion located on a rear side of the shaft holding surface and above the shaft holding surface and configured to restrain the shaft section from rearward movement to prevent the shaft section from being dislodged from the shaft holding surface, and a guide portion located on a rear side of the dislodgement prevention portion and configured to come into contact with the lower end portion of the shaft section of the connection member that is suspended by the weight of the connection member from the second connection end portion when the upper rear leg and the lower rear leg are raised to extend substantially vertically from a state where the upper rear leg and the lower rear leg are lowered and folded, the guide portion being inclined downward and frontward so as to guide the shaft section to the shaft holding surface; and a part of the connection member which part includes at least the shaft section is capable of relative displacement to the shaft holding portion in a rotation radial direction of rotation of the connection member around the second connection end portion, the relative displacement allowing the shaft suction to climb over the dislodgement prevention portion.

2. The gantry for a construction machine according to claim 1, wherein the shaft section is provided at such a position in the connection member that a distance between the shaft section and the second connection end portion is smaller than a distance between the shaft section and the first connection end portion, and the shaft holding portion is provided at such a position in the upper rear leg that a distance between the shaft holding portion and the first upper end portion is smaller than a distance between the shaft holding portion and the first lower end portion.

* * * * *